US005682727A

United States Patent [19]

Harte et al.

[11] Patent Number: 5,682,727

[45] Date of Patent: Nov. 4, 1997

[54] COUPLED CUTTING BLADE AND HEAT ELEMENT FOR USE WITH VACUUM PACKAGING MACHINERY

[75] Inventors: James R. Harte; James S. Colmer, both of Overland Park, Kans.; Michael L. Kennedy, Grain Valley, Mo.

[73] Assignee: Koch Supplies, Inc., Kansas City, Mo.

[21] Appl. No.: 643,269

[22] Filed: May 3, 1996

[51] Int. Cl.[6] ..... B65B 31/00

[52] U.S. Cl. ..... 53/434; 53/512

[58] Field of Search ..... 53/432, 434, 477, 53/510, 512

[56] References Cited

U.S. PATENT DOCUMENTS

| | | | |
|---|---|---|---|
| 3,688,463 | 9/1972 | Titchenal | 53/434 |
| 3,958,391 | 5/1976 | Kujubu | 53/434 |
| 4,251,976 | 2/1981 | Zanni | 53/434 |
| 4,457,122 | 7/1984 | Atkins et al. | 53/434 |
| 4,541,224 | 9/1985 | Mugnai | 53/434 |
| 4,545,177 | 10/1985 | Day | 53/434 |
| 4,553,376 | 11/1985 | Okada et al. | 53/434 |
| 4,581,764 | 4/1986 | Plock et al. | 53/434 |
| 4,583,347 | 4/1986 | Nielsen | 53/434 |
| 4,640,081 | 2/1987 | Kawaguchi et al. | 53/510 |
| 4,903,459 | 2/1990 | Okinaka | 53/434 |
| 4,941,310 | 7/1990 | Kristen | 53/434 |
| 5,386,678 | 2/1995 | Kujubu | 53/434 |

*Primary Examiner*—Daniel Moon
*Assistant Examiner*—Ed Tolan
*Attorney, Agent, or Firm*—Kokjer, Kircher, Bowman & Johnson

[57] ABSTRACT

A combined cutting blade and heat bar for use with a vacuum packaging device having a lid for sealing over the cavity of a base is disclosed. The cutting blade and heat bar are connected to one another and movable via a single actuating mechanism mounted to the lid. In use, in one step the combined mechanism is lowered with the heat bar unheated and the cutting element cuts slits in the bag for evacuation of the air. After air evacuation, the combined mechanism is lowered with the heat bar heated, melting the bag closed behind the slitted area of the bag.

20 Claims, 3 Drawing Sheets

COUPLED CUTTING BLADE AND HEAT ELEMENT FOR USE WITH VACUUM PACKAGING MACHINERY

FIELD OF THE INVENTION

The present invention relates to a mechanism for use with a vacuum packaging apparatus. More particularly, the invention is a combined cutting blade and heatable bar for use in cutting and sealing a vacuum packing bag in a vacuum packaging operation.

BACKGROUND OF THE INVENTION

Manufacturers often desire to package their products in air-tight or shrinked bags. For example, a manufacturer may wish to seal a food product in an air-tight package in order to ensure its freshness. Also, it is sometimes either expensive to package a product in a box or desirable to visibly display the product. In these cases, the manufacturer may shrink-wrap the product in a clear plastic bag. This type of packaging allows the consumer to see the product, and also protects the product during shipping.

Currently, machinery is available for packaging products in air-tight bags. This machinery typically comprises a base member having an upstanding wall defining an internal cavity in which a bagged product may be placed. A lid is movable over the base, the lid having a perimeter sealing element for forming a seal against the top of the wall of the base.

A movable heated element is connected to the lid. The heated element can be extended downwardly against a portion of the base. Means are provided for evacuating the air from the cavity.

In use, a product is placed in a plastic bag in the cavity of the base. The open end of the bag is oriented so that it extends across a portion of the base, with the free end located in a slot within the cavity. The lid is lowered and sealed against the base. The cavity, and thus the bag therein, is evacuated of air, the air leaving the bag through its open end. Evacuation of the air in the bag draws the bag tightly around the product and itself.

The heated element is then heated and lowered against the bag. The heat element melts the bag distal of its open end, sealing it shut. Air is returned to the cavity, the lid opened, and the product is removed.

This packaging arrangement suffers the drawback that the entire bag must be located in the cavity in order to evacuate the air therein. When there is excess bag to wrap the product, the bag material is bunched around and often extends from the product. This bag material increases the total size of the package, and is visually unappealing.

It is often desirable to limit the amount of bag surrounding the product. This is accomplished most easily by pulling the bag tightly around the product before it is evacuated. Unfortunately, this is made difficult, if not impossible, by the fact that the entire bag must remain in the cavity. Thus, even if the bag is pulled tightly around the product, once the user lets loose of it, the bag often slips back down around the product.

At least one mechanism has been developed in an attempt to solve this problem. A mechanism marketed under the name "Web-O-Matic" allows a user to leave the end of the bag outside of the chamber during air evacuation.

When using this device, the user places the product in the bag and pulls the end of the bag outside of the base. The user pulls the bag firmly outwardly, pulling the bag tightly around the product in the chamber, leaving only the amount of bag necessary to wrap the product around the product.

The user then lowers the lid, tightly holding the bag in place, preventing it from slipping back down into the chamber around the product. A cutting element mounted to the lid lowers and cuts a portion of the bag located inside of the chamber. The air in the chamber and bag is then evacuated, the air escaping from the bag through the cut. A separate heated element is then lowered, melting the bag distal of the cut made in the bag and sealing it shut. The wrapped product is then removed from chamber.

This mechanism suffers from the drawback that its cutting element and heated element move independently of one another, requiring two separate actuating mechanisms. In particular, order to achieve the correct pressure necessary to cut the bag, the cutting element is actuated by a first set of pneumatic cylinders. Similarly, the heated element is actuated by a second set of pneumatic cylinders. The necessity of having two separate actuating mechanisms increases the complexity of manufacturing the machine, and thus its cost.

A simple mechanism for cutting and sealing a bag in a vacuum packaging operation is desired.

SUMMARY OF THE INVENTION

A mechanism for use with a vacuum packaging device is disclosed. The vacuum packaging device, of the type known in the prior art, has a base and lid. A cavity is located in the base in which a product to be packaged is positioned. The lid has a perimeter seal for sealing the lid over the cavity in the base. The device further includes an apparatus for evacuating air from the sealed cavity and the bag inside.

The present invention is mechanism having a combined cutting blade and heatable element for use with the vacuum packaging device. The cutting blade is elongate and has a segmented cutting edge. The heatable element is a heat bar containing a heatable wire covered with Teflon™ tape.

The blade and bar are connected to one another and a mounting bar. The mounting bar is in turn connected to a single actuating device, an air bladder. The entire mechanism is mounted on a pair of rotatable arms connected to the lid of the vacuum packaging device, with the cutting blade oriented so as to face outwardly of the heat bar with respect to the outer wall of the base.

In conjunction with the cutting blade and heat bar, a neoprene anvil is mounted in the base adjacent the cavity. The anvil is positioned for engagement by the blade and heat bar.

The mechanism of the present invention is useful in forming a sealed package utilizing the vacuum packaging device. A user places a product in a bag having an open end. The user extends the open end of the bag across the anvil and positions the open end of the bag outside of the base, leaving the remainder of the bag containing product positioned in the cavity of the base.

The user closes the lid and a slight vacuum is drawn to seal the lid tightly against the base. The air bladder is then filled, pressing the combination cutting blade and heat bar downwardly, with the heat bar unheated. The cutting blade cuts spaced slits across the bag distal of its open end within the cavity. The air bladder is then evacuated, raising the combined cutting blade and heat bar.

The vacuum device evacuates the air in the cavity and the bag. Air in the bag escapes through the slits formed by the cutting blade.

The air bladder is then filled again, lowering the combination cutting blade and heat bar downwardly against the bag. This time the heat bar is heated, and when the heat bar presses against the bag, it melts the bag shut. This seal is formed distal of the cutting bar, effectively sealing off the portion of the bag containing the product.

The combination cutting blade and heat bar is raised, and the user opens the lid and removes the packaged product.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
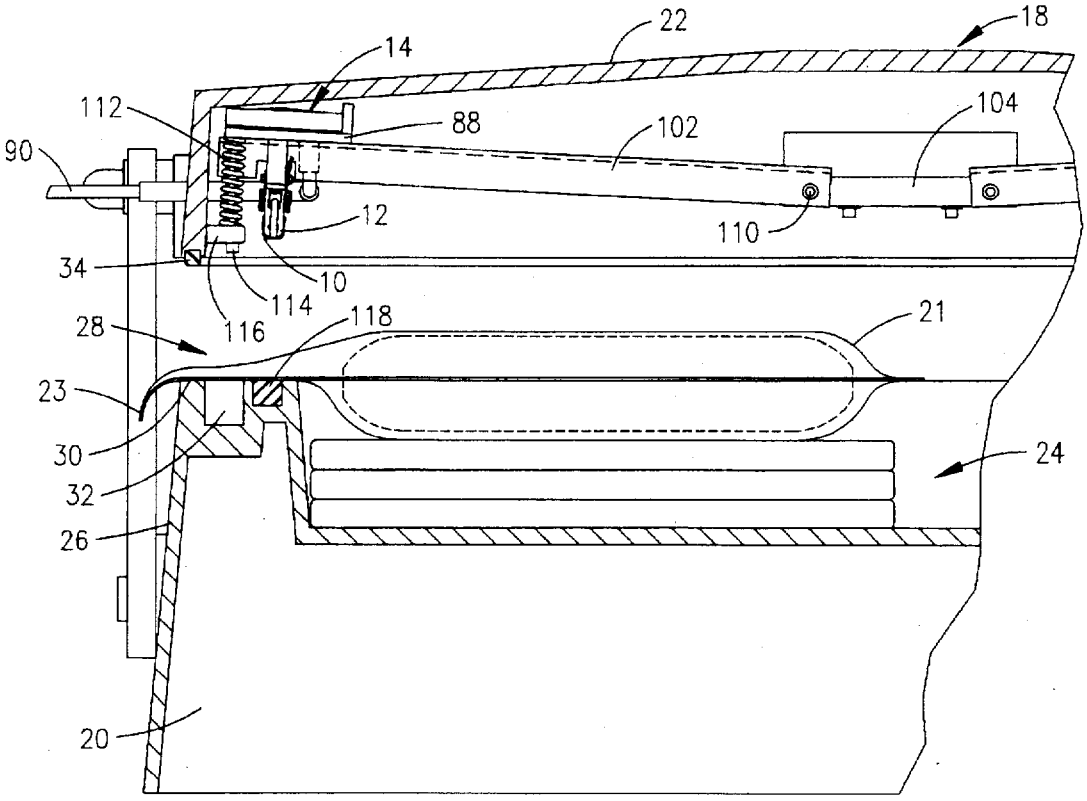
FIG. 1 is an end view of the combined cutting blade and heat bar apparatus of the present invention mounted in a vacuum packaging device (shown in cross-section) and shown with a lid of the device open.
Figure 4:
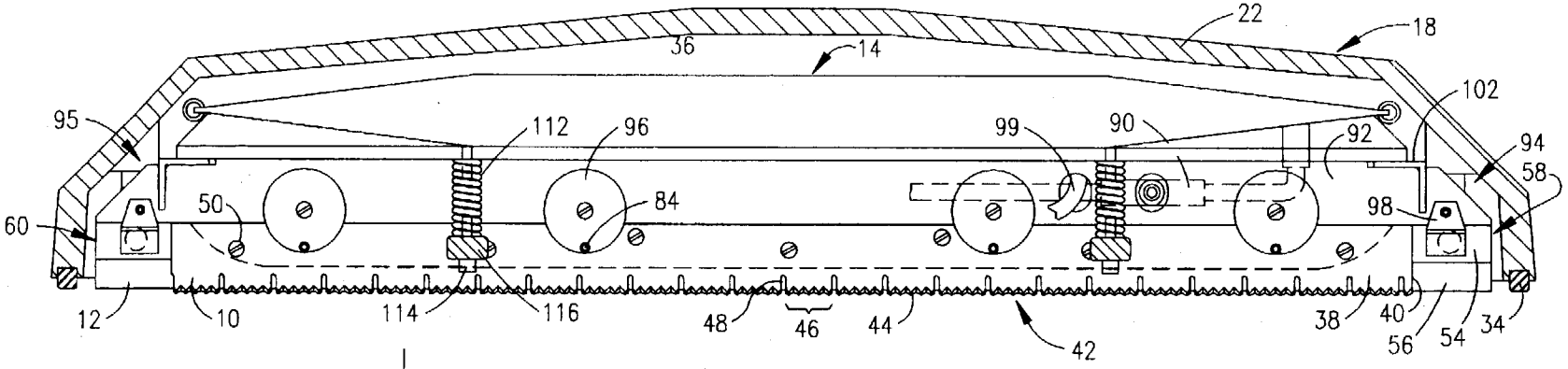
FIG. 4 is a cross-sectional side view of the apparatus of FIG. 2 taken along line 4—4 thereof.

Referring to FIGS. 1 and 4, the mechanism of the present invention generally comprises a cutting blade 10 and a heatable element, in the form of a heat bar 12, connected to one another and a single actuating mechanism 14. The mechanism is designed for use with a vacuum packaging machine 18.

The vacuum packaging machine 18 is well known in the art. Relevant portions of this machine 18 are described for the benefit of understanding the relationship of this mechanism to a vacuum packaging machine and the method of packaging utilizing the mechanism of the present invention.

The vacuum packaging machine 18, includes a base 20 and a lid 22. A cavity 24 is formed within an upstanding wall 26 of the base, the cavity having an open top end 28. The wall 26 has a flat top surface 30. At least a portion of the wall 26 includes a slot 32 in which a portion of a packaging bag 21 may be positioned.

The lid 22 has a mating surface for engagement with the top surface 30 of the wall 26 of the base 20, the lid 22 designed for use in enclosing the cavity 24 in the base. A seal 34 is positioned in the lid 22 for engagement with the top surface 30 of the wall 26 for sealing the lid to the base. The machine 18 includes means (not shown) for evacuating the air from the enclosed cavity 24, as is well known in the art.

In accordance with the present invention, the combined cutting blade 10 and heat bar 12 are mounted to the lid 22 of the vacuum packaging apparatus 18. The cutting blade 10 and heat bar 12 are connected to the actuating means 14, namely an expandable air bladder 36, for movement with respect to the lid.

The elements of the invention will now be described in more detail with reference made to FIGS. 1, 4 and 5.

Figure 5:
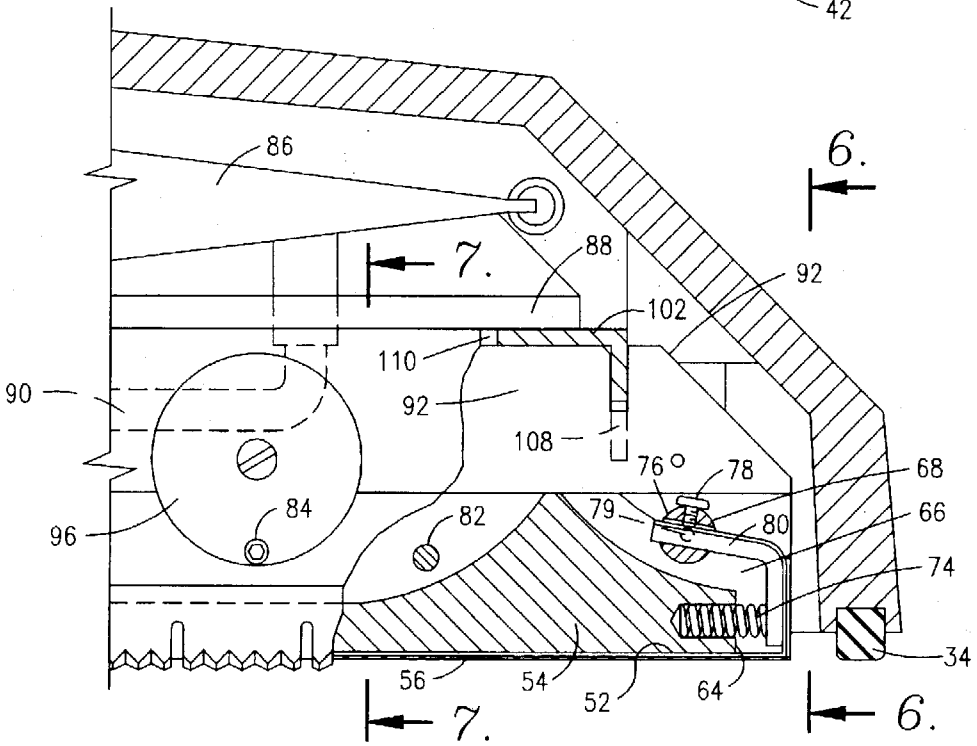
FIG. 5 is an enlarged, partial cut-away side view of the combined cutting blade and heat bar of FIG. 1.

As best illustrated in FIGS. 4 & 5, the cutting blade 10 comprises an elongate, thin metal member having a first side 38, second side 40 and cutting edge 42. A number of cutting teeth 44 are disposed along the cutting edge 42 of the blade 10.

Preferably, the cutting teeth 44 are divided into sets 46. In the method of the present invention it is desirable to not cut a packaging bag 21 completely across, but instead to cut it so that several portions of the bag remain unsevered. As such, the cutting teeth 44 are arranged so that the blade 10 acts to cut the bag in certain areas but not others. Preferably, the sets 46 of the cutting teeth 44 are separated by non-cutting slot 48 areas extending upwardly into the blade from the cutting edge.

The cutting teeth 44 are preferably only disposed on the first side 38 of the cutting blade 10, the second side 40 of the blade being flat. The cutting teeth 44 preferably have a cutting edge slope of about 60 degrees (sloping inwardly from the first side to the second side of the blade from the top of the tooth downwardly towards the cutting edge).

Each cutting tooth 44 is approximately 0.2 inches wide. The tooth 44 has a minimum tooth height of about 0.04–0.06 inches, and most preferably about 0.05 inches, and a maximum tooth height of about 0.145–0.165 inches, and most preferably about 0.155 inches.

The blade 10 may be constructed of any number of durable materials, and is preferably constructed from stainless steel. The blade 10 in the present example is about 24 inches long. The length of the blade 10 may vary, however, dependent on the application for which it is used.

A number of apertures extend through the blade 10. Screws 50 or similar mounting elements pass through the apertures for engagement with a base 54 of the heat bar 12, for mounting the blade to the actuating mechanism 14 (indirectly) as described in more detail below. The depth of the blade 10 and its point of attachment are chosen so that the ends of the teeth 44 extend below the bottom of the heat bar 12 by approximately 0.05–0.15 inches, and more preferably, about 0.1 inches, when the teeth have the configuration described above.

The heat bar 12 comprises a heat wire 52 mounted in the base 54. A cover 56 extends over the heat wire 52, preventing direct contact of the heat wire 52 with the bag 21.

Figure 7:
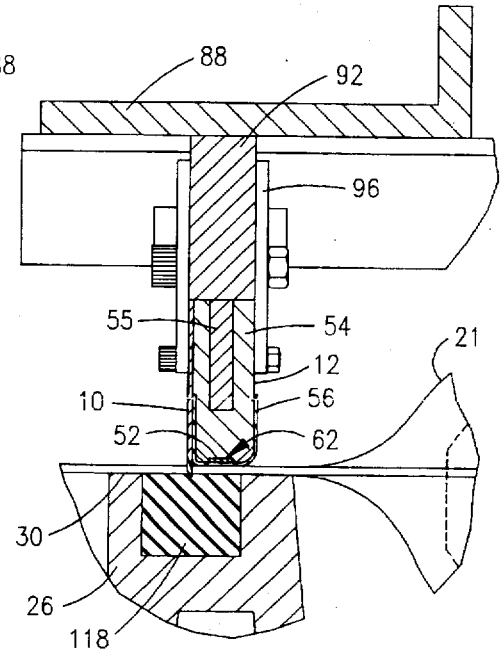
FIG. 7 is an enlarged cross-sectional end view of the apparatus in the position of FIG. 2 through line 7—7 of FIG. 5.

The base 54 comprises an elongate mounting member having a first end 58 and second end 60. Preferably, the base 54 is constructed of a lightweight resin material. In order to stiffen the base 54, an insert 55 (as best seen in FIG. 7), such as a metal bar, fits within a slot in the base 54.

The base 54 is preferably slightly longer than the cutting blade 10, at about 27.25 inches. As best illustrated in FIGS. 5 and 7, a first slot 62 extends through the base 54 from end to end 58, 60. The first slot 62 is preferably located adjacent a bottom edge 64 of the base 54 and receives the heat wire.

A second slot 66 extends into each end 58, 60 of the base 54 above the first slot 62. An aperture 68 extends through the base 54 from side to side at the location of the second slot 66.

The wire 52 has a first end and a second end, corresponding to the ends 58, 60 of the base 54. The wire 52 is preferably constructed of metal, and has a rectangular cross-section. At its ends the wire 52 first bends upwardly for extension along the ends 58, 60 of the base 54, and then bends inwardly.

To support the ends of the wire 52 and retain the wire in place, the wire extends over a lock bar 80 at each end. Preferably, the supporting/attaching structure is the same at both ends of the wire 52 and bar, and thus only one end will be described. As illustrated in FIG. 5, the lock bar 80, which is generally "L"-shaped, extends from a slot in a pin 76 passing through the aperture 68. A set screw 79 extends inwardly from one side of the pin 76, engaging the lock bar 80 and retaining it in place. From the pin, the lock bar 80 extends outwardly towards the first end 58 of the base 54, and then downwardly towards the bottom edge 64.

The heat wire 52 extends upwardly over the lock bar 80 within the slot 66. The first end of the wire 52 is retained against the lock bar 80 and in the pin 76 via a set screw 78 which passes downwardly from the top edge of the base 54.

As illustrated in FIG. 5, a spring 74 extends between the end of a countersunk bore in the base 54 near the second slot 66 and the lock bar 80, pressing the lock bar 80 outwardly against the heat wire 52.

A cover 56 extends over the bottom edge 64 of the base 54 from the first to the second ends 58, 60. The cover 56 is preferably a Teflon™ tape formed into a "U"-shape. The tape is connected to each side of the base 54 and extends across the bottom edge 64 of the base 54.

As illustrated, the front side of the base 54 has an inset area for acceptance of the cutting blade 10. A first number of apertures 82 pass through the base 54 of the heat bar 12 at the inset area. The first set of apertures are designed for acceptance of the screws 50 (or other mounting members) which connect the cutting blade 10 to the base 54.

A second number of apertures 84 pass through the base 54 of the heat bar 12 slightly above the first set. The second set of apertures 84 are designed for mounting the heat bar 12 (with blade connected thereto) to the actuating mechanism 14, as described below.

Figure 2:
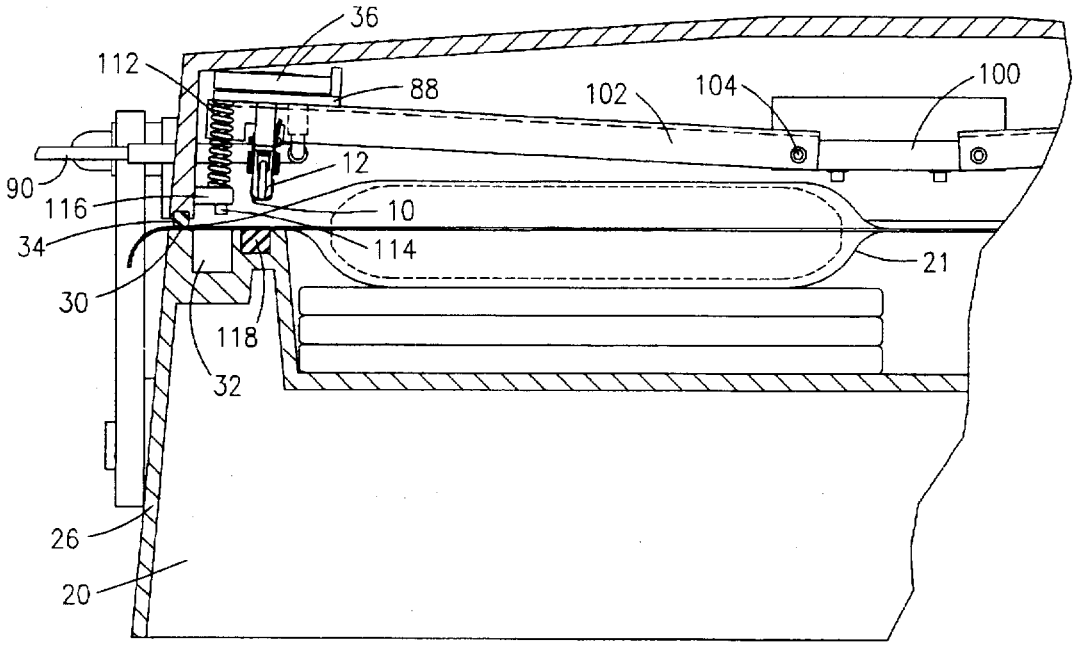
FIG. 2 is a view of the apparatus of FIG. 1, with the lid of the vacuum packaging device closed and the combined cutting blade and heat bar shown in a retracted position.
Figure 6:
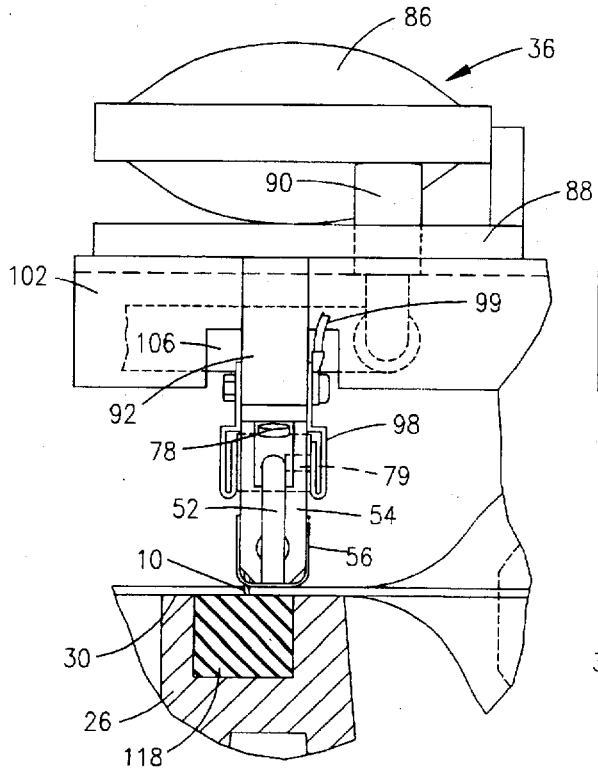
FIG. 6 is an enlarged end view of the apparatus illustrated in the position of FIG. 2 through line 6—6 of FIG. 5.

As best illustrated in FIGS. 2, 4 and 6, the actuating mechanism 14 comprises a means for moving/actuating the combined cutting blade 10 and heat bar 12 between a first (retracted) and a second (extended) position. Preferably, the actuating mechanism 14 comprises an air bladder 36. The air bladder 36 includes an inflatable element 86, such as a section of firehose or similar durable expandable material. The inflatable element 86 is mounted on a plate 88 having a flat surface and upstanding inside protective edge.

An air line 90 extends through the lid 22, an aperture in the plate 88, and into the inflatable element 86 of the air bladder 36. The air line 90 is connected to a source of high and low pressure air (not shown) for inflating and deflating the air bladder 36.

The air bladder 36 is connected to the cutting blade 10 and heat bar 12 via a mounting bar 92, as illustrated in FIGS. 4 and 7. The mounting bar 92 is approximately as long as base 54 of the heat bar 12 and thus slightly longer than the cutting bar 10. The mounting bar 92 has a first end 94 and second end 95 which are tapered to facilitate retraction of the mechanism along the sloping ends of the lid 22 of the vacuum packaging device 18, as best illustrated in FIG. 4.

Preferably, four large washers 96 are connected to each side of the mounting bar 92 with screws or the like. The base 54 of the heat bar 12 (to which the cutting blade 10 is connected by screws 50) is connected to the washers 96 with screws passing into the apertures 84 described above.

The mounting bar 92 is in turn connected to the flat portion of the plate 88 of the air bladder 36. Screws or similar attachment means pass through the plate 88 along its length and into mating apertures in the top edge of the mounting bar.

As connected, the mounting bar 92, the heat bar 12 and the cutting blade 10 move as one element as actuated by the air bladder 36, as described in more detail below. Thus, the cutting blade and heat bar are actuatingly coupled.

A wire 99 from an electrical power source (not shown) extends to electrical contact elements 98 connected to the mounting bar 92. Each contact element 98 has a first flat section which is attached, via a screw or the like to the mounting bar 92. Each element further includes a "U"-shaped, spring section. As illustrated, the spring section of the elements 98 contact the pin 76 to which the heat wire 52 is connected. The wire 99 is connected to the elements 98 for heating the heat wire 52. The elements 98 are mounted beyond the ends of the cutting blade 10, so as to not contact the cutting blade.

Figure 3:
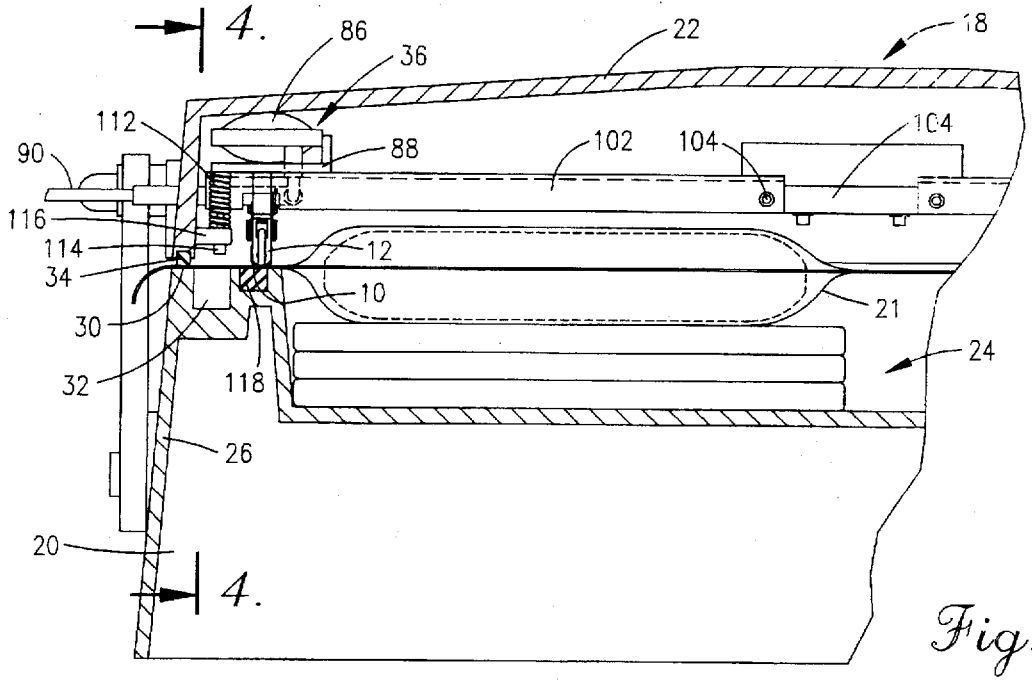
FIG. 3 is a view of the apparatus of FIG. 2 with the combined cutting blade and heat bar shown in an extended position.

The entire mechanism is preferably hingedly connected to the lid 22 of the vacuum packaging device 18, as best illustrated in FIGS. 1–3. Two mounting blocks 100 (only one of which is illustrated) are connected to the inside of the lid 22 of the vacuum packaging device 18. An arm 102 extends from each mounting block 100 to a connection with the mounting bar 92 and plate 88.

Each arm 102 has a generally "L"-shaped cross-section, and is generally about 15–16 inches, and most preferably about 15.75 inches long. The length of the arm 102 depends primarily on the size of the lid in which the mechanism is mounted. Preferably, the arm 102 is connected at one end to the mounting block 100 near the center of the lid. The arm 102 is long enough that the combined cutting blade 10 and heat bar 12 are positioned adjacent the outer edge of the lid 22, as illustrated in FIG. 1. The arm 102 is hingedly connected to the mounting block 100 at a first end via a pin 104.

The second end of each arm 102 is connected to the ends, respectively, of the flat portion of the plate 88 (see FIG. 5). The arms 102 are connected to the plate 88 with screws or similar attachment means.

The second end of each arm 102 includes a slot 106 (FIG. 6) for mating engagement with a corresponding slot 108 (FIG. 7) in the top edge of the mounting bar 92. Preferably, the slot 106 in the arm 102 is longer than the mounting bar 92 is wide, and the slot 108 in the mounting bar 92 is deeper than the depth of the downwardly extending portion of the arm 102, to facilitate relative movement of the two elements. Further, in order to accommodate mounting of the arm 102 under the plate 88 and between the plate and mounting bar 92, the mounting bar includes a recessed top edge section 110 at each end.

Springs 112 bias the mechanism upwardly into a recessed position within the lid 22 when the air bladder 36 is deflated, as illustrated in FIGS. 1 and 3. Preferably, two pins 114 (see FIG. 4) extend downwardly from the plate 88 and engage a flange 116 extending inwardly from the inside surface of the lid 22. The springs 112 are mounted on the pins 114 between the flange 116 and plate 88.

An anvil 118 is positioned in the wall 26 of the base 20 of the vacuum packaging apparatus 18 directly below the cutting blade 10, as illustrated in FIGS. 1 and 2. Preferably, the anvil 118 comprises an elongate segment of neoprene extending within a slot in the wall 26 along that portion of the wall 26 beneath the mechanism of the present invention.

Use of the mechanism of the present invention will now be described in conjunction with FIGS. 1–3 and 6–7. First, a user of the vacuum packaging device 18 fitted with the mechanism of the present invention opens the lid 22 thereof, as illustrated in FIG. 1. The user positions an item to be sealed with a bag 21. The user positions the bag 21 in the cavity 24 within the base 20 of the device 18, extending the open end 23 of the bag outside of the device.

The user then closes the lid 22, as illustrated in FIG. 2. The seal 34 on the lid 22 seals the lid against the base 20. A slight vacuum is then drawn, evacuating some of the air from within the cavity 24. This partial vacuum is drawn in order to better seal the lid 22 to the base 20, and to prevent the lid 22 from raising when the cutting blade 10 is lowered and cuts the bag 21. Care is taken, however, not to draw an excessive vacuum, as such could have the effect of rupturing the bag 21, as the air within the bag at that time has no path of escape.

The combined cutting bar 10 and heat bar 12 is then lowered into the position as illustrated in FIG. 3. In particular, air is forced through the air line 90 into the inflatable element 86 of the air bladder 36. Inflation of the air bladder 36 presses the combined cutting blade 10 and heat bar 12 downward until it engages the anvil 118, as illustrated in FIGS. 3, 6 and 7.

Most importantly, at this time the heat bar 12 is unheated. When in the extended position, the cutting bar 12 cuts the bag 21, forming spaced slits therein. Air is then removed from the air bladder 36 through the air line 90, the air bladder collapsing and the spring force generated by the springs 112 pressing the mechanism upwardly into the lid 22 as illustrated in FIG. 2. At the same time, full vacuum is drawn within the device 18, drawing the remaining air from the cavity 24 and the bag 21. The air in the bag 21 escapes through the slits cut in it by the cutting blade 10.

The heat wire 52 of the heat bar 12 is then heated, and the mechanism lowered to the positioned illustrated in FIG. 3 again. At this time, the heat bar 12 melts the bag 21 closed inward of the slits. The mechanism is again raised, air returned to the cavity 24, such as by venting to the outside atmosphere, and the user opens the lid. The user then removes the sealed bag 21. If desired, the user may remove the excess bag 21 distal of the sealed end by tearing it along the slits.

Notably, the cutting blade 10 extends below the heat bar 12 a sufficient distance to cut through the bag 21 when the mechanism is lowered against the anvil 118. This extension distance is chosen, however, so that the heat bar 12 still contacts the bag 21 as necessary to melt the bag closed. At the same time, the teeth 44 of the blade 10 do not penetrate so far into the anvil 118 so as to become lodged or stuck, which would hinder operation of the machine.

The sequence of (1) pulling initial vacuum; (2) lowering mechanism to cut the bag; (3) raising the mechanism and pulling full vacuum; (4) heating heat bar and lowering mechanism to seal bag; and (5) raising mechanism is preferably accomplished with relays or the like so as to be automatic.

While an air bladder 36 has been described as the preferred actuating device, many other similar mechanisms could be employed. For example, hydraulic or air cylinders could be used to move the combined cutting blade and heat bar up and down.

Further, the specific configuration of the heat bar or connecting apparatus could be change substantially without falling from the scope of the invention. A wide variety of heatable elements are well known in the art, and may be employed instead of the one described here.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of vacuum packaging a product comprising the steps of:

extending a cutting blade and a connected heat bar as one element against a bag having an open end and a closed distal end;

cutting a portion of said bag with said cutting blade;

retracting the cutting blade and the connected heat bar as one element;

evacuating air from inside said bag through the cut portion;

heating the connected heat bar; and extending the cutting blade and the connected heat bar as one element with the connected heat bar contacting a part of said bag spaced from the portion of said bag cut with said cutting blade toward the distal closed end.

2. The method of claim 1, wherein said extending steps further comprise the step of inflating an air bladder connected to said connected cutting blade and heat bar.

3. The method of claim 1, wherein said cutting blade and heat bar are actuatingly connected and are connected to a lid of a vacuum packaging apparatus and said extending steps comprise the step of lowering said cutting blade and heat bar downwardly from said lid.

4. The method of claim 1, further including the step of melting said bag when said heat bar extends against said bag.

5. The method of claim 1, wherein said cutting step comprises the formation of a multiplicity of intermittent slits in said bag.

6. The method of claim 1, further including the step of locating an open end of said bag outside of a sealed base and lid of a vacuum packaging device.

7. The method of claim 6, further including the step of evacuating a portion of the air in said vacuum packaging device before said cutting step.

8. The method of claim 1, wherein the extending steps comprise connecting said cutting blade and said heat bar to a first end of each arm of a pair of arms, and rotatably connecting said arms at their second ends to a lid of a vacuum packaging device.

9. The method of claim 1, wherein the cutting blade and the heat bar are connected and the extending and retracting steps comprise simultaneously extending and actuating the cutting blade and heat bar.

10. The method of claim 1, wherein the air is evacuated after the cutting blade is retracted.

11. A mechanism for use with a vacuum packaging device which vacuum seals a bag, the mechanism having a base with a cavity therein and a lid, and said mechanism comprising:

a cutting blade;

a heat bar connected to the cutting blade;

actuating means for simultaneously actuating said cutting blade and connected heat bar, said actuating means mounted to the lid of said vacuum packaging device, said actuating means for extending the cutting blade and the connected heat bar as one element with the connected heat bar contacting a part of said bag spaced from a portion of said bag cut with said cutting blade toward a distal closed end of the bag.

12. The mechanism of claim 11, wherein said means for actuating comprises an air bladder.

13. The mechanism of claim 11, wherein said cutting blade has a first side and a second side and cutting teeth formed in only one of said sides.

14. The mechanism of claim 11, wherein said cutting blade has at least one set of cutting teeth separated from another set of cutting teeth.

15. The mechanism of claim 14, wherein said cutting teeth extend along an edge of said blade, said sets of cutting teeth separated by at least one slot extending into said blade along said edge.

16. The mechanism of claim 11, wherein said heat bar comprises a heatable wire mounted in a base and covered by a covering.

17. The mechanism of claim 11, further including an air bladder connecting plate, said cutting blade and heat bar connected to said plate.

18. The mechanism of claim 11, further including an anvil mounted to said base of said vacuum packaging device.

19. The mechanism of claim 18, wherein said anvil comprises a neoprene material.

20. The mechanism of claim 11, wherein the cutting blade and heat bar are actuatingly coupled.

* * * * *